US006694968B1

(12) United States Patent
Dienner et al.

(10) Patent No.: US 6,694,968 B1
(45) Date of Patent: Feb. 24, 2004

(54) LINEAR MULTI-OIL FURNACE AND HEAT EXCHANGER

(75) Inventors: Jacob Dienner, Narvon, PA (US); Douglas Stoltzfus, Gordonville, PA (US); Eli Stauffer, Narvon, PA (US); Frederick W. Phillips, Leola, PA (US)

(73) Assignee: Clean Burn, Inc., Leola, PA (US)

( * ) Notice: Subject to any disclaimer, the term of this patent is extended or adjusted under 35 U.S.C. 154(b) by 0 days.

(21) Appl. No.: 10/306,399

(22) Filed: Nov. 27, 2002

Related U.S. Application Data

(60) Provisional application No. 60/333,860, filed on Nov. 28, 2001.

(51) Int. Cl.[7] ..... F24H 3/02

(52) U.S. Cl. ..... 126/110 B; 126/116 R; 126/110 D

(58) Field of Search ..... 126/104 A, 110 R, 126/110 B, 110 D, 110 E, 116 R, 60, 116 A, 67, 85 R; 236/96; 432/222

(56) References Cited

U.S. PATENT DOCUMENTS 2,737,173 A * 3/1956 Hauck et al. ..... 126/110 B
4,319,713 A * 3/1982 Baker ..... 236/96
4,729,365 A * 3/1988 Mutchler ..... 126/110 B
4,955,359 A 9/1990 Briggs et al. ..... 126/110 R
5,363,836 A 11/1994 Briggs ..... 126/109
5,409,373 A 4/1995 Phillips et al. ..... 431/208
5,435,718 A 7/1995 Briggs ..... 431/90
5,494,025 A 2/1996 Smoker et al. ..... 126/104 R
5,531,212 A 7/1996 Smoker et al. ..... 126/104 R
6,386,193 B1 * 5/2002 Knodel ..... 126/110 B

* cited by examiner

*Primary Examiner*—James C. Yeung
(74) *Attorney, Agent, or Firm*—Miller Law Group, PLLC

(57) ABSTRACT

A multi-oil fired furnace having a heat exchanger that extends rearwardly of the combustion chamber and utilizes laminar air flow around the combustion chamber to minimize the width and height dimensions of the cabinet shell for the furnace. The heat exchanger includes an exhaust header having a central opening and a cluster of concentrically arranged exhaust tubes connected to the combustion chamber. A vertical baffle forces the flow of air through a central opening that is concentric with the combustion chamber into a group of horizontal baffles directing the air into a generally laminar flow pattern against the outer surface of the combustion chamber before being discharged from the cabinet shell in a selected one or more of three possible directions. The fan control switch is mounted on a mounting plate that is welded to the combustion chamber to provide a planar contact surface for the switch mechanism.

26 Claims, 8 Drawing Sheets

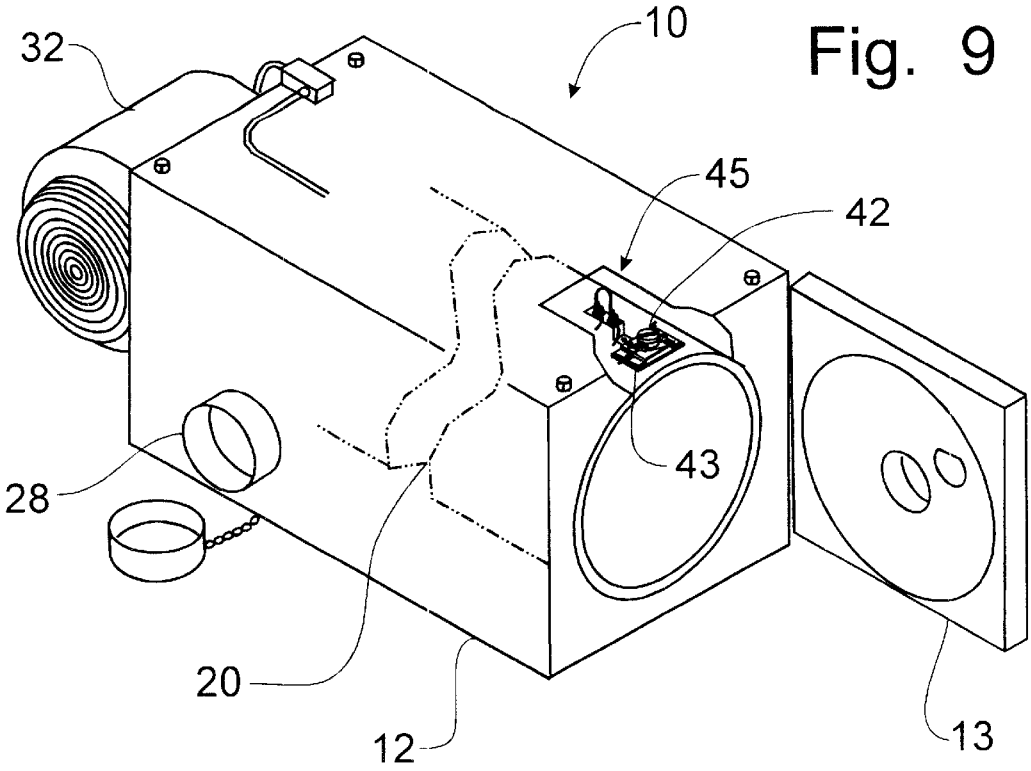
Fig. 9
Fig. 10
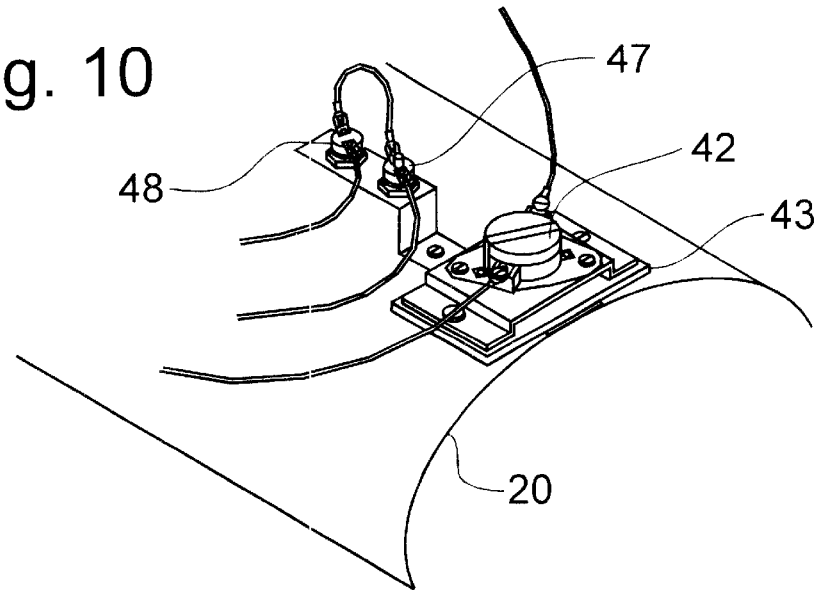

LINEAR MULTI-OIL FURNACE AND HEAT EXCHANGER

CROSS-REFERENCE TO RELATED APPLICATIONS

This application claims domestic priority on U.S. Provisional Patent Application Serial No. 60/333,860, filed on Nov. 28, 2001, the contents of which are incorporated herein by reference.

BACKGROUND OF THE INVENTION

This invention relates generally to an furnace and associated heat exchanger that are arranged in a generally linear configuration and, more particularly, to a heat exchanger that can be positioned behind the furnace to extract heat therefrom for dispersion into the surrounding environment or to a remote location.

Generally, multi-oil furnaces, sometimes referred to as a used-oil fired furnace because of the primary utilization thereof to burn used oil removed from automobiles and the like as well as standard grades of fuel oils, utilize an air-to-air heat exchanger with a blower than moves ambient air through the furnace structure and/or around the combustion chamber to transfer heat generated within the combustion chamber to a remote location for desired utilization thereof. An efficient air-to-air heat exchanger is shown and described for multi-oil furnaces in U.S. Pat. No. 5,494,025, issued to Benjamin K. Smoker and David J. Yoder on Feb. 27, 1996. This heat exchanger generally surrounds the burner chamber by circulating the combustion gases from the rear of the furnace by an upper set of conduits leading to a header in front of the furnace and then through a lower set of conduits to the rear of the furnace again where the gases are exhausted from the furnace. The ambient ventilation air is passed vertically through the assembly to absorb heat from the conduits and the burner chamber before being discharged from the furnace.

The heat exchanger described in U.S. Pat. No. 5,494,025 requires a cabinet shell having a height greater than the height of the burner chamber due to the upper and lower banks of conduits transferring the combustion gases around the burner chamber to exchange heat with the ambient ventilation air. Likewise, the width of the cabinet shell is required to be greater than the width of the burner chamber. In some installations, the height and/or width requirements will not permit the utilization of a cabinet shell that is significantly greater than the corresponding dimensions of the burner chamber.

Accordingly, it would be desirable to provide a multi-oil furnace that orients the air-to-air heat exchanger substantially rearwardly of the burner chamber so as to minimize the height and/or width dimensions of the furnace cabinet shell.

The thermostat controls for the switch associated with the operation of the fan is conventionally mounted on the circular combustion chamber to sense the temperature of the burner chamber. The switch is operable to start the motion of the fan to push room air through the heat exchanger when the combustion chamber has obtained a high enough temperature to expel warm air through the heat exchanger. Other thermostatic switches control the operation of the burner and are conventionally mounted in close proximity to the fan switch, but are operable to sense the temperature within the cabinet shell of the furnace. These other thermostatic switches are operable to shut down the burner in the event the temperatures get too high, such as could result if there is a failure in the fan to blow the cooling room air through he heat exchanger, and to control the ability to re-start the burner only when the temperature has sufficiently cooled.

The mounting of a flat fan control switch device on the outer circumference of a circular chamber results in a linear contact between the switch and the burner chamber. Tolerances to establish a properly operable switch in such circumstances are difficult to maintain. Since the fan switch will not start the operation of the fan until a minimum temperature setting has occurred, a fan control switch device that falls outside the acceptable tolerances can result in a premature shut down of the burner, because the temperature in the cabinet shell has increased above the maximum permissible by the other thermostatic switches without causing activation of the fan due to the improper sensing of the temperature of the combustion chamber.

Accordingly, an improved mounting for the fan control switch would be desirable to improve the operational performance of the furnace.

SUMMARY OF THE INVENTION

It is an object of this invent ion to provide a heat exchanger for a multi-oil furnace that overcomes the aforementioned disadvantages of the known heat exchangers.

It is another object of this invention to provide a heat exchanger for a multi-oil fired furnace that does not require a large cabinet shell to encase the heat exchanger and combustion chamber of the furnace.

It is still another object of this invention to provide a multi-oil furnace with a heat exchanger that enables the combustion chamber of the furnace to have a diameter and length to avoid impingement, metal deterioration, and carbonization from the operation thereof.

It is a feature of this invention that the heat exchanger does not restrict the diameter of the combustion chamber of a multi-oil furnace with respect to the overall size of the cabinet shell that encompasses the furnace and heat exchanger.

It is an advantage of this invention that the heat exchanger configuration extends the operative life of the combustion chamber because of the lack of restriction on the diameter of the combustion chamber.

It is another feature of this invention that the heat exchanger is formed with a plurality of exhaust tubes positioned behind the combustion chamber to transfer heat from the exhausted combustion gases to room air being circulated through the cabinet shell.

It is another advantage of this invention that the positioning of exhaust tubes in line with the combustion chamber reduces the height and width of the cabinet shell needed to house the heat exchanger for a multi-oil furnace.

It is still another feature of this invention that the exhaust tubes are connected to an exhaust header to collect the exhausted combustion gases before being discharged from the furnace.

It is still another advantage of this invention that the provision of an exhaust header rearwardly of the combustion chamber enables the combustion gases to be discharged from either side of the furnace.

It is still another feature of this invention that the exhaust header is provided with multiple discharge outlets for selective use to discharge the combustion gases from the furnace.

It is still another object of this invention to enhance the exchange of heat from the combustion chamber to room air being circulated through the cabinet shell.

It is yet another feature of this invention that the combustion chamber is provided with horizontal baffles to direct room air into a generally laminar flow over the surface of the combustion chamber.

It is still another feature of this invention that the room air is forced through a vertical baffle opening concentric with the combustion chamber before being engaged by the horizontal baffles directing room air along the surface of the combustion chamber.

It is yet another object of this invention to control the flow path of the room air through the cabinet shell in a manner to maximize the transfer of heat from the combustion process to the room air.

It is a further feature of this invention that room air is directed through a central opening through the exhaust header to cause room air to be circulated between exhaust tubes extending between the combustion chamber and the exhaust header, before being forced through an annular opening in a vertical baffle around the combustion chamber and into engagement with horizontal baffles to direct the room air into a laminar flow pattern along the surface of the combustion chamber.

It is a further advantage of this invention that the heat exchanger configuration causes room air to be circulated more equally to prolong the life of the heat exchanger due to stresses resulting from unequal heat distribution.

It is a further object of this invention to provide an improved mounting of the fan control switch on the combustion chamber to enhance the sensing of the temperature of the combustion chamber.

It is yet another advantage of this invention that the control of the operation of the blower fan to move room air through the heat exchanger is improved.

It is still a further feature of this invention that the fan control switch is mounted on a linear plate welded to the top of the combustion chamber for a consistent planar contact between the fan control switch and the combustion chamber.

It is a further advantage of this invention that the sensing of the temperature of the combustion chamber is sensed more accurately for the controlling of the operation of the blower fan on a multi-oil fired furnace.

It is still a further advantage that the contact between the fan control switch and the combustion chamber is planar, rather than linear, due to the welding of a mounting plate on the combustion chamber and forming an integral part thereof.

It is yet a further object of this invention to provide a heat exchanger for use with a multi-oil furnace which is durable in construction, inexpensive of manufacture, carefree of maintenance, facile in assemblage, and simple and effective in use.

It is still another object of this invention to provide a mounting for a fan control switch for use on a multi-oil fired furnace which is durable in construction, inexpensive of manufacture, carefree of maintenance, facile in assemblage, and simple and effective in use.

These and other objects, features, and advantages are accomplished according to the instant invention by providing a multi-oil fired furnace having a heat exchanger that extends rearwardly of the combustion chamber and utilizes laminar air flow around the combustion chamber to minimize the width and height dimensions of the cabinet shell for the furnace. The heat exchanger includes an exhaust header having a central opening and a cluster of concentrically arranged exhaust tubes connected to the combustion chamber. A vertical baffle forces the flow of air through a central opening that is concentric with the combustion chamber into a group of horizontal baffles directing the air into a generally laminar flow pattern against the outer surface of the combustion chamber before being discharged from the cabinet shell in a selected one or more of three possible directions. The fan control switch is mounted on a mounting plate that is welded to the combustion chamber to provide a planar contact surface for the switch mechanism.

BRIEF DESCRIPTION OF THE DRAWINGS

The advantages of this invention will become apparent upon consideration of the following detailed disclosure of the invention, especially when taken in conjunction with the accompanying drawings wherein:

FIG. 9 is a schematic upper left front perspective view of the multi-furnace incorporating the principles of the instant invention with a portion of the cabinet shell at the front of the furnace being broken away to depict the fan control switch and the thermostatic switches monitoring the temperature of the air within the cabinet shell; and FIG. 10 is an enlarged detail view of the fan control and thermostatic switches mounted on the combustion chamber as depicted in FIG. 9.

DETAILED DESCRIPTION OF THE PREFERRED EMBODIMENTS

Figure 1:
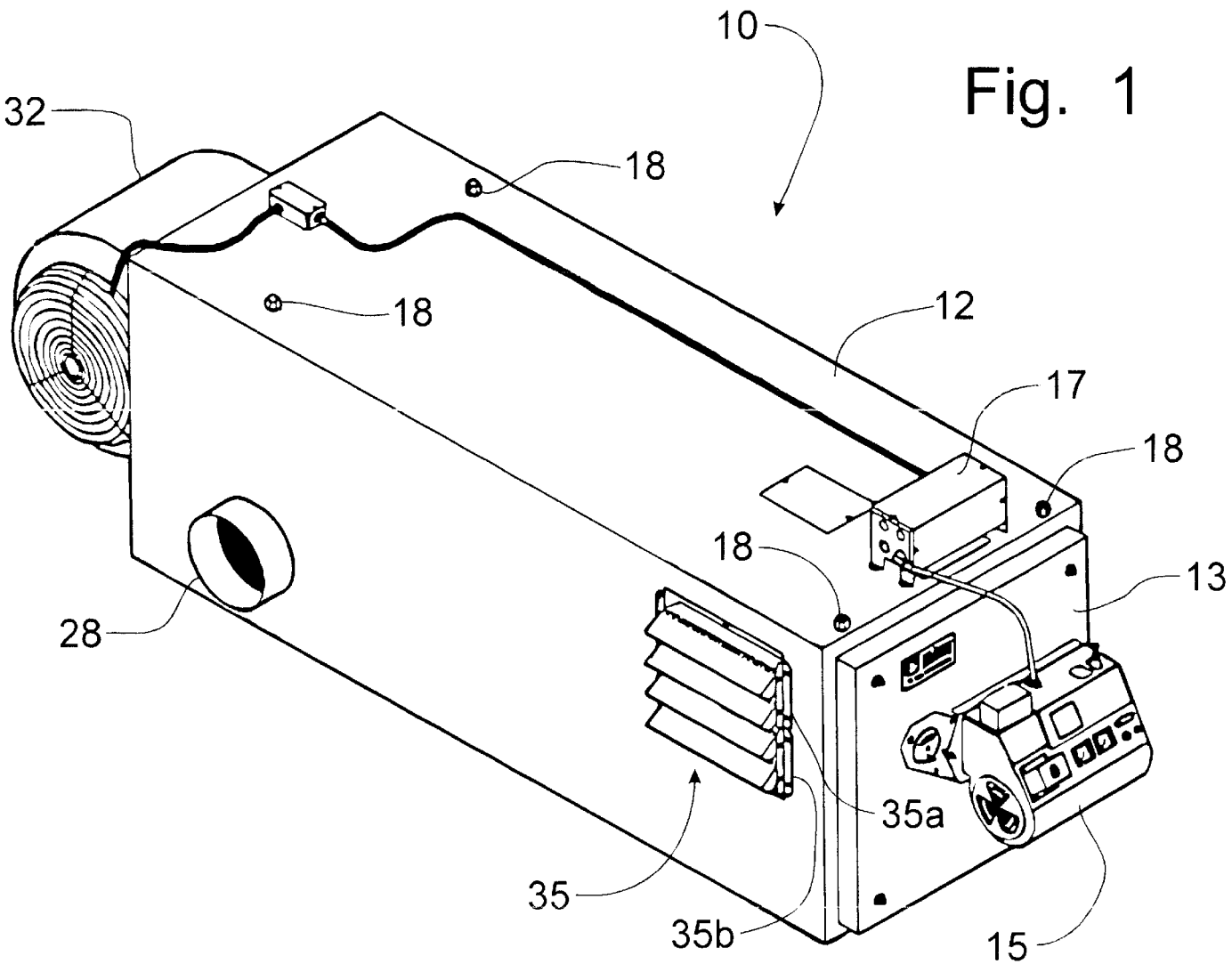
FIG. 1 is an upper left, front perspective view of a multi-oil furnace incorporating the principles of the instant invention.
Figure 2:
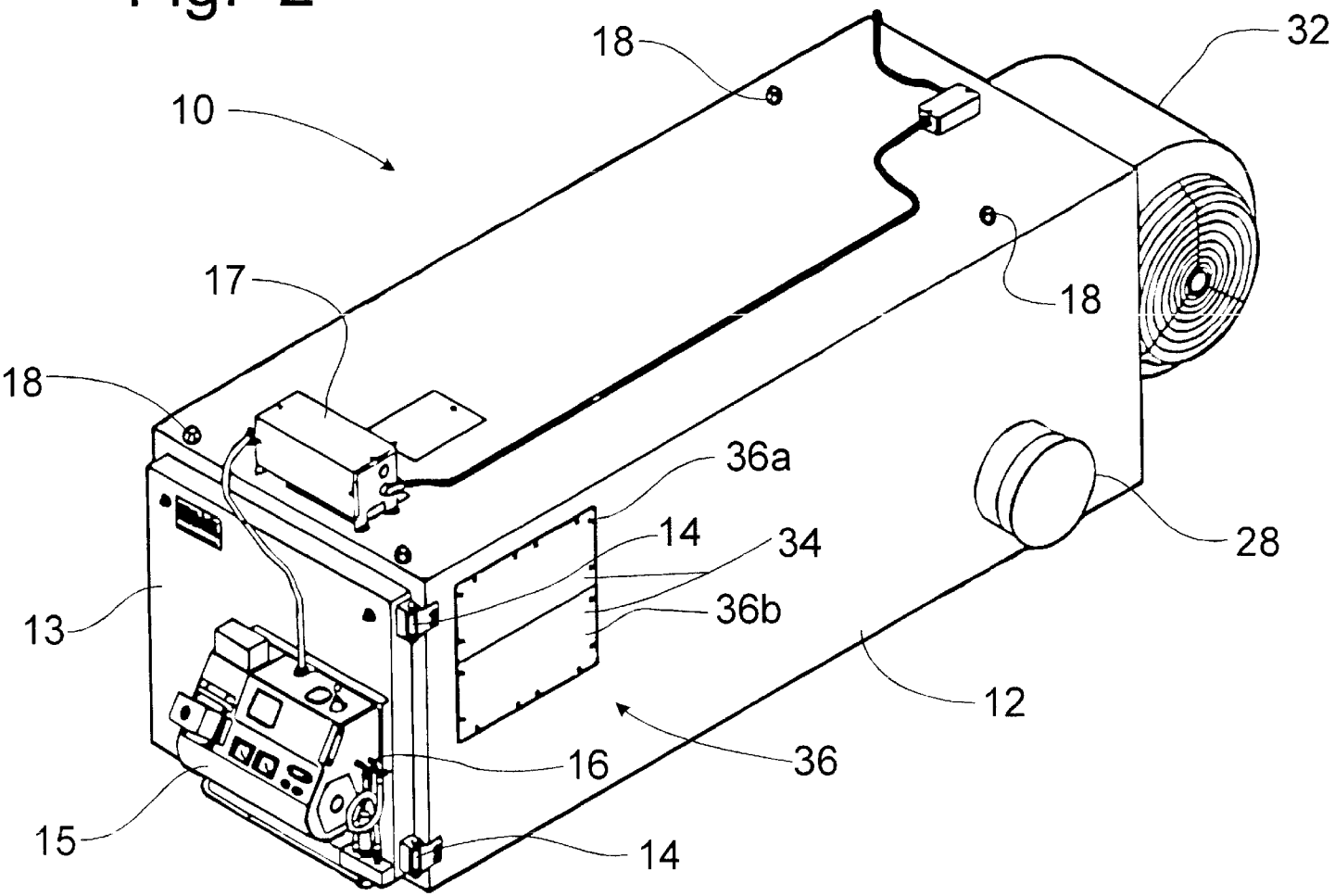
FIG. 2 is an upper right, front perspective view of the multi-oil furnace shown in FIG. 1.
Figure 3:
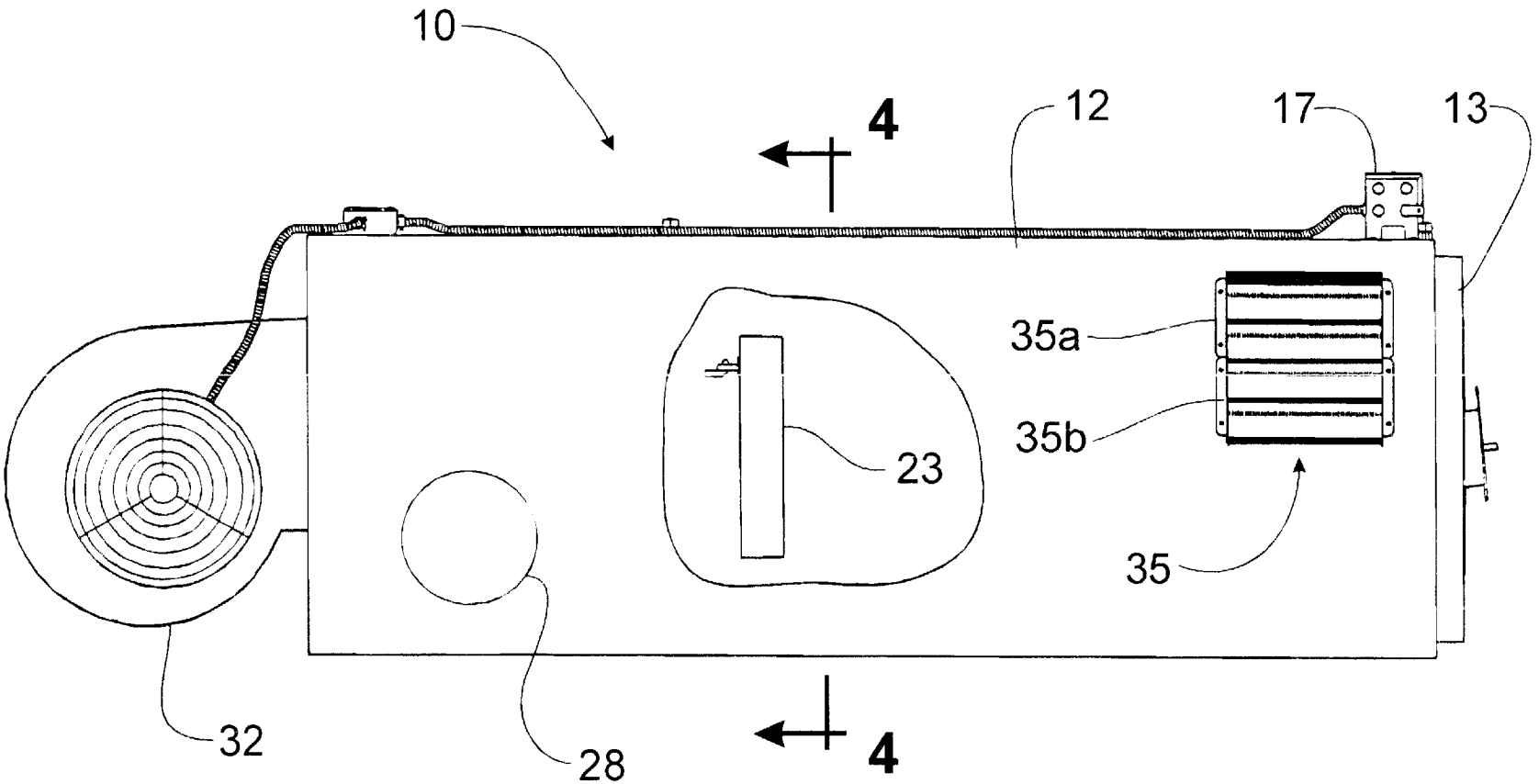
FIG. 3 is a left side elevational view of the multi-oil furnace shown in FIG. 1, a central portion of the cabinet shell being broken away to depict the location of the cupped target of the burner chamber, the burner assembly being removed for purposes of clarity.
Figure 4:
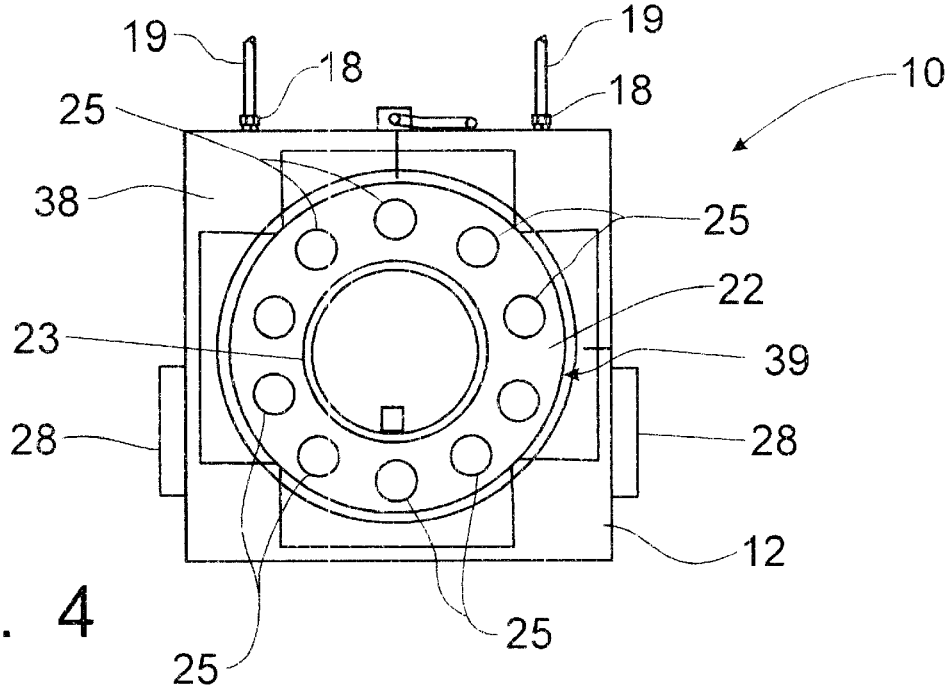
FIG. 4 is a cross-sectional view taken along lines 4—4 of FIG. 3 to depict the rear wall of the burner chamber.
Figure 5:
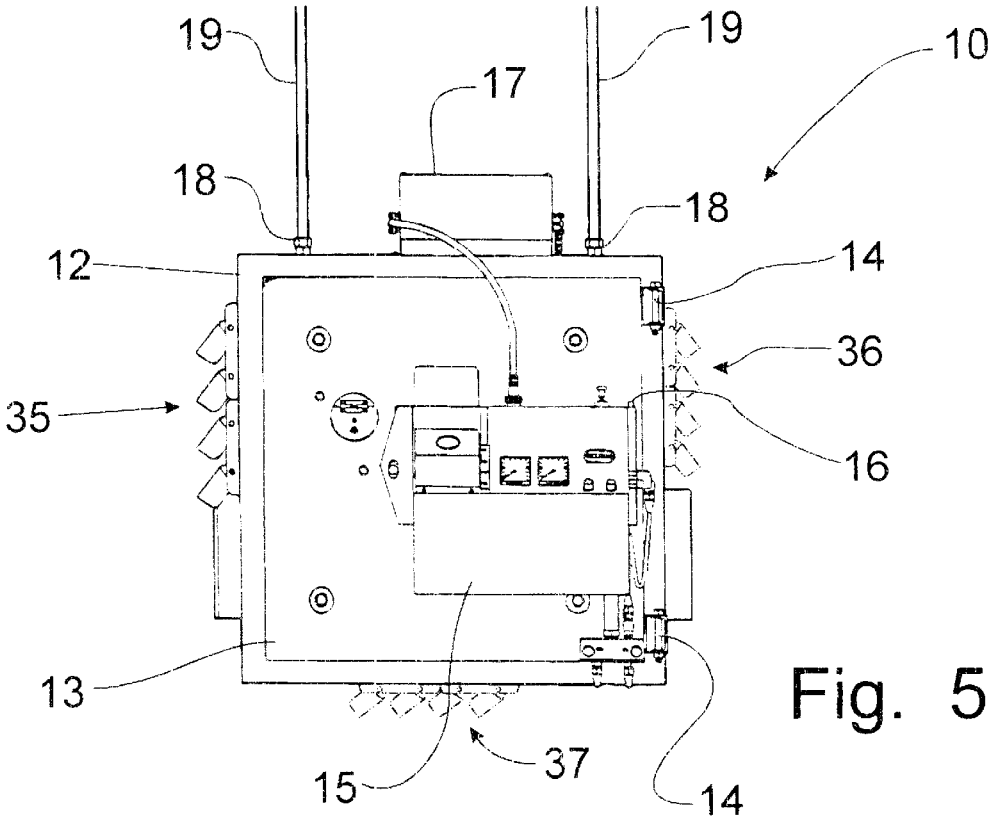
FIG. 5 is a front elevational view of the multi-oil furnace shown in FIGS. 1–3, typical threaded mounting rods used in the installation of the multi-oil furnace being depicted at the top of the cabinet shell.

Referring now to FIGS. 1–6, a multi-oil furnace incorporating the principles of the instant invention can best be seen. Any left and right references used herein are determined by standing at the front of the furnace facing the multi-oil burner mounted on the access door. The general configuration of the burner chamber and burner are shown and described in detail in U.S. Pat. No. 5,531,212, issued on Jul. 2, 1996, to Benjamin K. Smoker, et al, entitled "Multi-Oil Furnace"; and in U.S. Pat. No. 5,409,373, issued on Apr. 25, 1995, to Frederick W. Phillips, et al, entitled "Burner Housing for Multi-Oil Furnaces", the contents of both of these patents being incorporated herein by reference. As best seen in FIGS. 4 and 5, the typical installation of a multi-oil furnace incorporating the principles of the instant invention is from the ceiling of a housing structure. Accordingly, the cabinet shell 12 is provided with a plurality of connector mounts 18 in the top surface thereof for engagement with threaded rods 19 to suspend the furnace 10 from an elevated structure (not shown).

Figure 6:
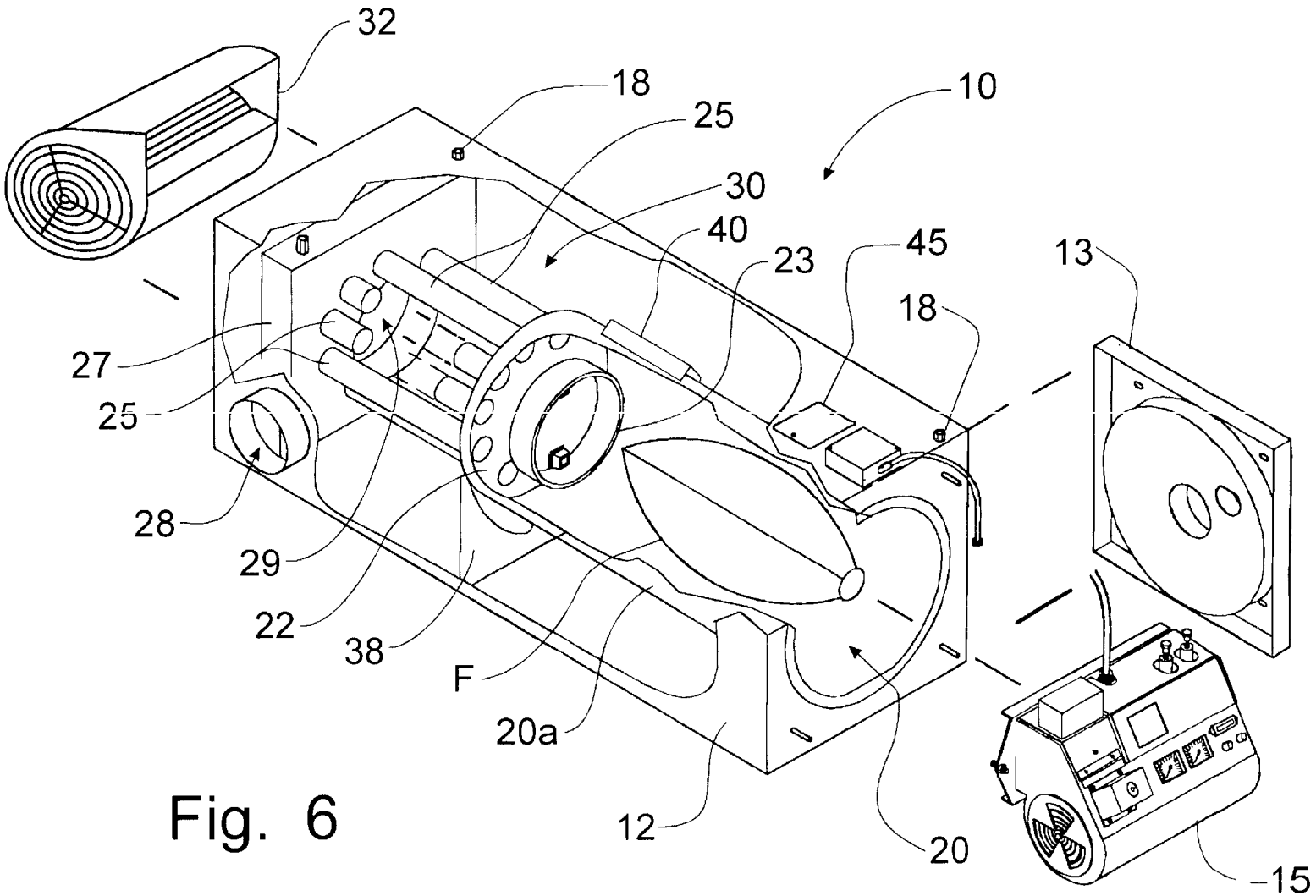
FIG. 6 is an exploded diagrammatic upper left, front perspective view of the multi-oil furnace similar to that depicted in FIG. 1, but having the majority of the cabinet shell broken away to depict the interior of the furnace, portions of the combustion gas exhaust tubes being broken away for clarity.

More specifically, the cabinet shell 12 of the multi-oil furnace 10 has a front door 13 on which is mounted a burner assembly 15 for pivotal movement about a generally vertical axis 16 to permit the burner assembly 15 to open away from the front door 13 for service and cleaning in a conventional manner. The front door 13 of the cabinet shell 12 is also pivotally mounted on the cabinet shell 12 by hinges 14 to permit the opening of the front door 13 for service and cleaning of the burner chamber 20. The burner chamber 20, which is best seen in FIG. 6, is generally cylindrical in shape and terminates at a back wall 22 on which is mounted a cupped ceramic target 23 to deflect the combustion gases outwardly around the edges of the target 23 to double back around the flame F generated by the burner assembly 15. The net result is that a greater burning efficiency is accomplished before the combustion gases are drawn out of the burner chamber 20 into the heat exchanger 30.

The back wall 22 of the burner chamber 20 is provided with a circular array of combustion gas exhaust tubes 25 that are uniformly distributed around the circumference of the target 23. The exhaust tubes 25 are open to the burner chamber 20 and serve to provide conduits for the escape of the combustion gases created in the burner chamber 20. The exhaust tubes 25 extend rearwardly from the back wall 22 of the burner chamber 20 through the heat exchanger 30 into a header 27 positioned at the rear of the cabinet shell 12. The header 27 is essentially a hollow box-like structure that is in flow communication with the full circular array of exhaust tubes 25 leading from the back wall 22 of the burner chamber 20. The header 27 collects the combustion gases from the exhaust tubes 25 and discharges the combustion gases through a discharge opening 28 which can be located on either side of the cabinet shell 12 which is connected to an exhaust device (not shown) to remove the combustion gases to the atmosphere.

With the above-described arrangement of components, the heated combustion gases generated by the flame F from the burner assembly 15 are doubled back by the ceramic or stainless steel target 23 and then reversed in direction to discharge from the burner chamber 20 through the rearwardly leading exhaust tubes 25 into the header 27 for ultimate discharge from the furnace 10. The exhaust tubes 25 extending between the back wall 22 of the burner chamber 20 and the header 27 are individual, discreet tubes 25 passing through and forming part of the heat exchanger 30. Thus, air can circulate between the exhaust tubes 25 to absorb heat therefrom, as will be described in greater detail below. The exhaust tubes 25 are sealed against both the back wall 22 and the header 27 to prevent any intermingling of the combustion gases with the ambient environment air that would cause contamination thereof.

Figure 7:
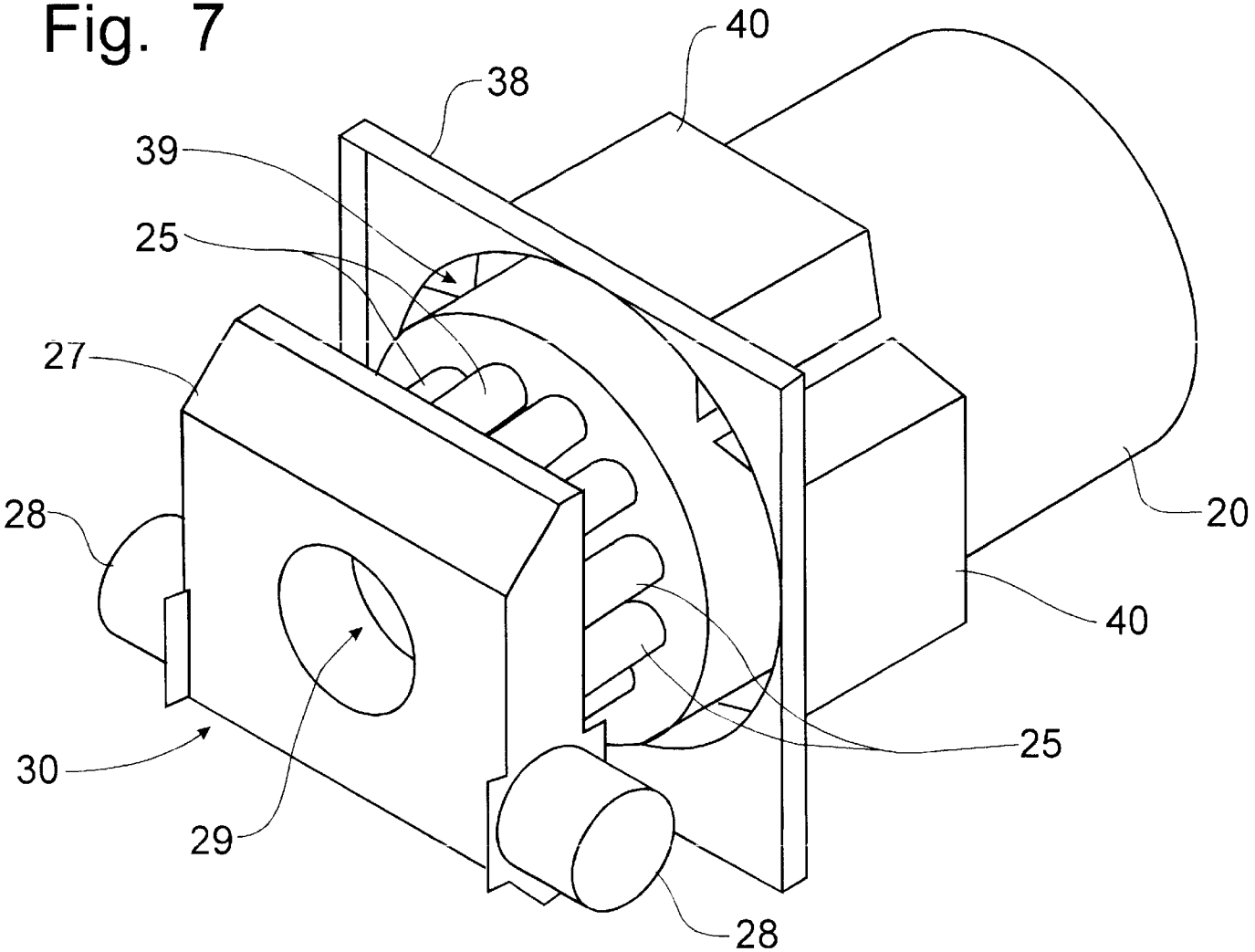
FIG. 7 is an upper left, rear perspective view of the heat exchanger and combustion chamber incorporating the principles of the instant invention, the shell of the multi-oil furnace being removed for purposes of clarity.
Figure 8:
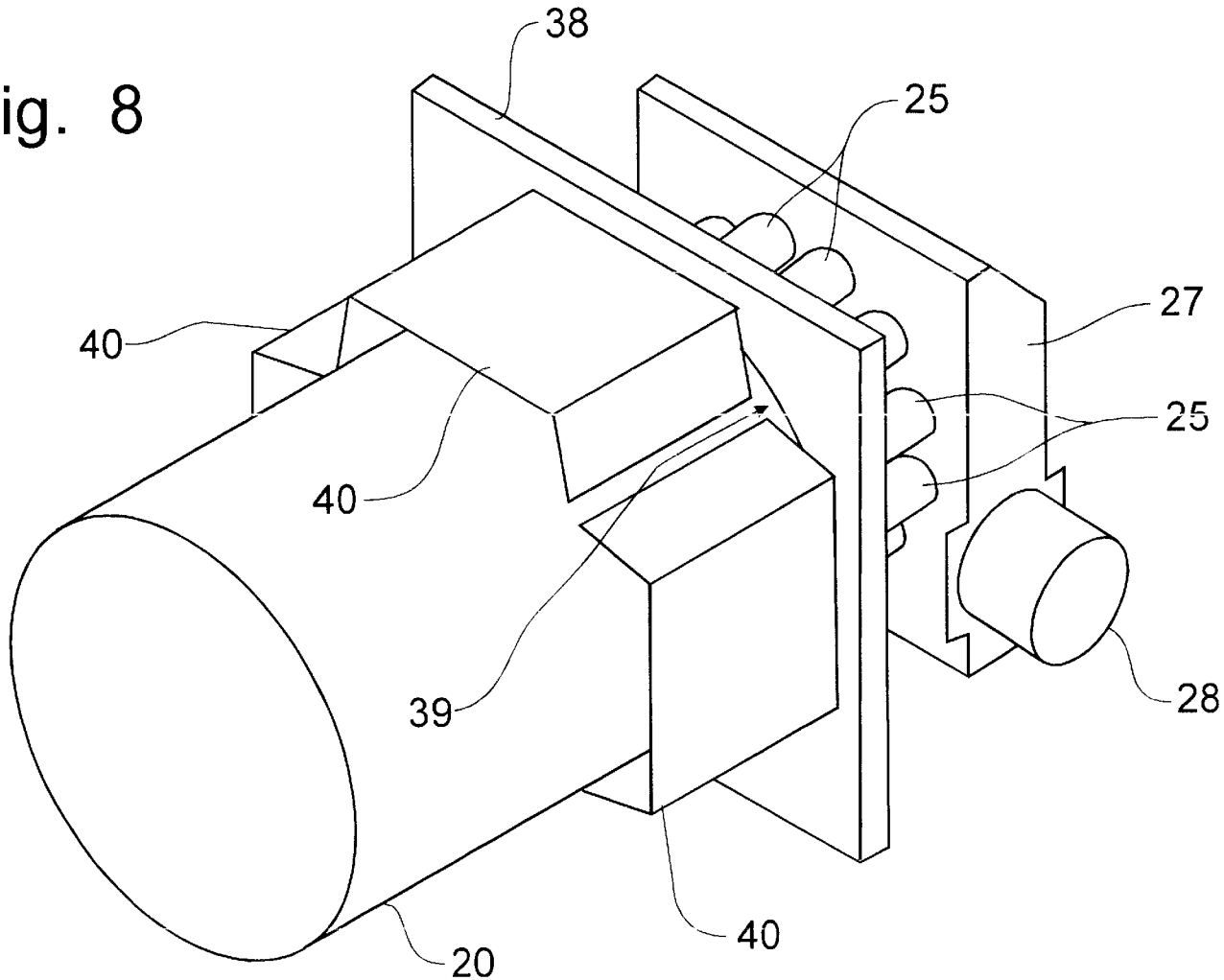
FIG. 8 is an upper right, front perspective view of the heat exchanger and combustion chamber shown in FIG. 7.

As best seen in FIGS. 6–8, the header 27 is formed with a sealed circular opening 29 passing completely through the header 27. The circular opening 29 is positioned within the interior circumference of the circular array of the exhaust tubes 25 where the exhaust tubes 25 engage the header 27. The opening 29 is sealed with respect to the header 27 so that the combustion gases collected therein do not pass into or through the opening 27, but extends completely through the header 27. Rearwardly of the header 27, the rear wall of the cabinet shell 12 is formed with an opening (not shown) that is in register with the circular opening 29 through the header 27. A blower 32 is supported on the rear wall of the cabinet shell 12 to blow ambient environment air from the surrounding structure through the opening 29 in the header 27 to absorb heat from the heat exchanger 30. In the alternative, the blower 32 could be conveying air from a remote source for heating in the heat exchanger 30 and return to the remote source.

The heat exchanger 30 is formed within the cabinet shell 12 primarily rearwardly of the burner chamber 20, but also extends around the outer periphery 20*a* of the burner chamber 20 to collect heat therefrom before passing through the selected heated air discharge opening 35–37 located forwardly on the cabinet shell, as will be described in greater detail below. Ambient air from the surrounding environment is blown through the opening 29 in the header 27 into the heat exchanger 30. The orientation of the opening 29 and the velocity provided to the air blown therethrough, primarily pushes the ambient air directly against the back wall 22 of the burner chamber 20. From the back wall 22, the air deflects in all directions and passes through the circular array of exhaust tubes 25, extending around and between the exhaust tubes 25 to absorb heat therefrom.

The cabinet shell 12 is preferably formed with a divider wall 38 that aligns with the back wall 22 of the burner chamber 20. The divider wall 38 preferably has an opening 39 concentric with the burner chamber 20 to define an annular gap around the exterior of the burner chamber 20 to force the ambient air to circulate around the burner chamber 20 before being discharged through the heated air discharge opening 35–37. Preferably, the space in the cabinet shell 12 surrounding the burner chamber 20 is be divided into passageways by horizontally, extending baffles 40 that are either welded to or supported on the burner chamber 20. The horizontal baffles 40 intercept the majority of the air forced through the annular opening 39 and direct the movement of the ambient air into a generally laminar flow path along the exterior of the burner chamber 20 to increase the transfer of heat from the burner chamber 20 to the ambient air before being discharged from the furnace 10 through the heated air discharge opening 35–37.

As best seen in FIG. 5, the cabinet shell 12 is provided with three alternate discharge openings 35–37, one 35 on the left side of the cabinet shell 12, one 36 on the opposite right side of the cabinet shell 12, and the third 37 on the bottom surface of the cabinet shell 12, that can be used to direct the discharge of warmed ambient air from the cabinet shell 12. Each discharge opening 35–37 is divided into two individual openings, for example 36*a*, 36*b*, to provide a number of selectable options for the discharge of warmed ambient air. Because of the size of the blower fan 32, any two of the individual openings, depicted in FIGS. 1, 3 and 5 as individual openings 35*a*, 35*b*, of the total of six such openings around the three sides of the cabinet shell 12 can be used to discharge warmed ambient air.

Using more than two of the individual openings can lead to an overworked and burned-out fan motor 32. Those individual openings, depicted in FIG. 2 as 36*a*, 36*b*, not utilized to discharge warmed ambient air will be covered with a blank 34 to prevent the discharge or air therefrom. Accordingly, the warmed ambient air could be selectively discharged all from the right side of the cabinet shell 12, the left side, or the bottom, as depicted in FIG. 5. One of the individual openings could be opened on any two of the sides for discharge of heated air simultaneously in different directions from the cabinet shell 12.

In operation, the multi-oil furnace 10 is mounted for operation, such as by suspending the furnace 10 by threaded rods 19 interconnecting an elevated structure (not shown) and the connector mounts 18 on the top of the cabinet shell 12. A supply of oil, such as used automotive oils, food service cooking oils or agricultural oils, is connected to the burner assembly in a conventional manner, such as is described in U.S. Pat. No. 5,531,212. Electrical power is provided through the junction box 17 coupled with an external source of electricity to provide electrical power to the burner assembly 15 to ignite the oil delivered to the burner assembly 15 and provide the flame F. The flame F is directed toward the cupped ceramic target 23 mounted on the rear wall 22 of the burner chamber 20, where the created hot combustion gases are doubled back on the flame F to provide an efficient burning of the oil before re-directing the path of the combustion gases back toward the rear wall 22 to pass into and through the circular array of the exhaust tubes 25 opened to the burner chamber 20 through the rear wall 25 thereof The heated combustion gases passing interiorly through the exhaust tubes 25 transfer heat through the walls of the exhaust tubes 25 to the ambient air being blown through the heat exchanger 30 through which the exhaust tubes 25 pass before connecting with the header 27. The combustion gases are then collected in the header 27 and discharged from the furnace 10 through the discharge opening 28. The combustion gases created from the ignition and combustion of the oil from the burner assembly 15 heats the structure of the burner chamber 20, the back wall 22, the exhaust tubes 25, and the header 27. Accordingly, heat can be absorbed from all of these devices. In addition, the annular nature of the header 27 and exhaust tube arrangement spreads the combustion gases around better to eliminate cold spots that cause premature wear within the exhaust system.

First, ambient air, whether from the immediate environment or a remote location, is blown into the heat exchanger 30 by a blower 32. The unheated air from the blower 32 is blown against and around the header 27 and, primarily, through the circular opening 29 passing through the header 27, gaining some heat transfer from the header 27. The air passing through the circular opening 29 is directed against the back wall 22 of the burner chamber 20 where some additional heat can be transferred to the ambient air. Primarily, however, most of the heat transferred to the ambient air blown into the heat exchanger 30 by the blower 32 is absorbed from the exhaust tubes 25 and, eventually, from the outer periphery 20*a* of the burner chamber 20.

After deflecting off of the rear side of the back wall 22 of the burner chamber 20, the ambient air is circulated around and outwardly through the array of exhaust tubes 25 and then through an annular opening 39 in the generally vertical divider wall 38 extending around the back wall of the burner chamber 20. The ambient air is then directed around the outer periphery 20*a* of the burner chamber 20 in a generally laminar flow path by the horizontal baffles 40 to absorb some additional heat from the burner chamber 20 before being discharged from the cabinet shell 12 through the utilized heated air discharge opening 35–37 near the front of the cabinet shell 12.

The above-described structure provides a multi-oil furnace that has a minimized height and width dimension in favor of an extended length dimension, as the heat exchanger is positioned primarily rearwardly of the burner chamber instead of primarily surrounding the burner chamber as is taught in U.S. Pat. No. 5,531,212. The circular opening 29 in the rear header 27 enables the ambient air to be directed through the header 27 to collect heat therefrom before being passed into the heat exchanger area 30 where the spaced exhaust pipes 25 are arranged in a circular array. The proven burner assembly 15 and burner chamber 20 construction can be maintained and incorporated into the new furnace design without sacrificing dimensional requirements of some installations. The heat exchanger 30 will provide an efficient air-to-air transfer of heat from the combustion gases. Service and cleaning efficiencies of the prior multi-oil furnace taught in the aforementioned U.S. Pat. No. 5,531,212, can also be retained due to the pivoted burner assembly 15 and the pivoted front door 13, and due to the positioning of the discharge opening 28 at the bottom of the header 27 to facilitate the cleaning of ash and other debris therefrom in an easy and convenient manner.

Referring now to FIGS. 9 and 10, the mounting of the thermostatic control switches can best be seen. The control switch 42 for initiating the operation of the blower 32 to blow ambient air through the heat exchanger 30 is mounted on the forward end of the burner chamber 20 for access through an access panel 45 on top of the cabinet shell 12. Typically, the fan control switch 42 is mounted directly on the outer periphery 20*a* of the burner chamber 20 such that the interaction between the switch and the burner chamber is a linear contact due to the planar switch meeting a circular burner chamber 20.

According to the principles of the instant invention, the fan control switch 42 is mounted on a mounting plate 43 which is preferably welded to the top surface of the burner chamber 20. The mounting plate 43 through its welded connection to the burner chamber 20 is substantially at the same temperature as the outer periphery 20*a* of the burner chamber 20. Thus, the mounting of the fan control switch 42 directly on the mounting plate 43 provides a generally planar contact for the fan control switch 42 to enhance the sensing performance of the switch.

In operation, the fan control switch 42 initiates the operation of the blower 32 whenever the temperature of the burner chamber 20 reaches a predetermined level so that the air being blown through the heat exchanger 30 by the blower 32 will extract heat from the heat exchanger 30 and blow warmed air from the discharge opening 35–37. Next to the fan control switch 42, also accessible through the access panel 45, are the high temperature limit switch 47 and the reset switch 48. If the temperature within the cabinet shell 12 exceeds a predetermined temperature, the high limit switch 47 will stop operation of the burner 15. The reset switch 48 is operable to re-start operation of the burner 15 whenever the temperature within the cabinet shell 12 has cooled sufficiently to permit safe operation of the furnace 10.

The mounting of the fan control switch 42 on the mounting plate 43 permits a more accurate sensing of the temperature of the burner chamber 20 due to the planar contact between the switch 42 and the plate 43. Proper operation of the fan control switch 42 will initiate operation of the blower to extract heat from the heat exchanger 30, thus cooling the temperature within the cabinet shell 12 before exceeding the maximum allowable temperature set by the high temperature limit switch 47.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A multi-oil furnace comprising:

a cabinet shell;

a burner chamber housed within said cabinet shell and including:

an elongated structure defining an exterior wall;

a back wall oriented generally perpendicularly to said exterior wall; and a target mounted on said back wall;

a burner assembly mounted on said cabinet shell to project a flame created from an ignition and combustion of fuel into said elongated chamber toward said target, said flame creating heated combustion gases;

a plurality of exhaust tubes connected to said back wall and encircling said target, said exhaust tubes being operable to provide a passageway for the removal of said combustion gases from said burner chamber, said exhaust tubes extending rearwardly from said back wall;

a header positioned rearwardly of said back wall and being connected to said exhaust tubes to collect combustion gases from all of said exhaust tubes, said header having a discharge opening therein for the discharge of the collected combustion gases from the furnace; and a fan operable to move ambient air through said cabinet shell to absorb heat before being discharged from the furnace.

2. The multi-oil furnace of claim 1 wherein said fan is operable to blow said ambient air around said exhaust tubes and said burner chamber to collect heat therefrom before being discharged from said furnace.

3. The multi-oil furnace of claim 2 wherein said header is formed with an opening through a central portion thereof opening into said plurality of exhaust tubes to permit the flow of ambient air through said opening to pass around said exhaust tubes.

4. The multi-oil furnace of claim 3 wherein said furnace includes a generally vertical first baffle generally aligned with said back wall of said burner chamber, said first baffle defining a passageway to permit the flow of ambient air around said exterior wall of said burner chamber.

5. The multi-oil furnace of claim 4 wherein said passageway is in the form of an annular opening around said burner chamber.

6. The multi-oil furnace of claim 5 wherein said exterior wall of said burner chamber is formed with a generally horizontal baffle apparatus to direct ambient air forced through said annular opening into a generally laminar flow along an outer surface of said exterior wall of said burner chamber.

7. The multi-oil furnace of claim 6 wherein said burner chamber is formed as a cylinder having an exterior wall with a generally circular cross-section, said horizontal baffle apparatus being formed as a plurality of planar baffles affixed to said exterior wall and extending generally parallel to said outer surface.

8. The multi-oil furnace of claim 7 wherein said cabinet shell is formed with a plurality of discharge openings for said ambient air for selectively directing the discharge of ambient air in a desired direction.

9. The multi-oil furnace of claim 8 wherein said discharge openings for said ambient air are divided into individual segments such that any two individual segments can be opened for the discharge of said ambient air in a desired direction, the remaining said individual segments being closed off to prevent the discharge of ambient air therefrom.

10. The multi-oil furnace of claim 3 wherein said header is smaller than said cabinet shell to permit room for said ambient air to move around said header to extract heat therefrom as well as to pass through said central opening.

11. The multi-oil furnace of claim 10 wherein said central opening through said header is sealed to retain said combustion gases within said header without mingling said combustion gases with said ambient air.

12. A heat exchanger for a multi-oil furnace having a burner chamber in which fuel is burned to create heat and a flow of combustion gases, comprising:

a plurality of exhaust tubes arranged in a generally circular array extending rearwardly from said burner chamber to carry said combustion gases away from said burner chamber, said array of exhaust tubes defining a diameter that is no greater than a corresponding diameter of said burner chamber;

a header positioned rearwardly from said burner chamber and being connected in flow communication with said exhaust tubes to receive said combustion gases therefrom; and a blower to force ambient air around said header and past said exhaust tubes and said burner chamber to extract heat therefrom.

13. The heat exchanger of claim 12 wherein said header is formed with a central opening extending therethrough with said circular array of exhaust tubes being positioned around said central opening, said blower being operable to blow at least a portion of said ambient air through said central opening to engage said exhaust tubes.

14. The heat exchanger of claim 13 wherein said blower is operable to direct the flow of ambient air within the interior of said circular array of exhaust tubes toward a generally orthogonal back wall of said burner chamber, said air being deflected off said back wall of said burner chamber to be passed between the individual exhaust tubes before being discharged from said furnace.

15. The heat exchanger of claim 14 further comprising:

a generally vertical baffle positioned forwardly of said exhaust tubes to force the flow of ambient air through a passageway to be directed against said burner chamber to absorb heat therefrom.

16. The heat exchanger of claim 15 wherein said passageway is in the form of an annular opening extending around said burner chamber.

17. The heat exchanger of claim 16 further comprising:

a generally horizontal baffle apparatus mounted on said burner chamber to receive ambient air passing through said annular opening and to direct said ambient air into a generally laminar flow path along an exterior surface of said burner chamber.

18. The heat exchanger of claim 17 wherein said horizontal baffle apparatus includes a plurality of planar baffles affixed to and extending generally parallel to said exterior surface of said burner chamber.

19. A method of absorbing heat from a furnace, having a burner chamber for burning fuel to create heat and combustion gases, into a flow of cooling air, comprising the steps of:

blowing said cooling air through a central opening in a header spaced rearwardly from said burner chamber and being connected to said burner chamber by a circular array of exhaust tubes for extracting said combustion gases from said burner chamber, said central opening being positioned within the midst of said circular array of exhaust tubes;

directing said cooling air between said exhaust tubes;

passing said cooling air through an annular opening within a generally vertical baffle positioned in generally alignment with a back wall of said burner chamber, said annular opening corresponding to an exterior surface of said burner chamber so that said cooling air passing through said annular opening passes along said exterior surface of said burner chamber;

deflecting said cooling air after passing through said annular opening by a generally horizontal baffle apparatus to direct said cooling air into a generally laminar flow path along said exterior surface of said burner housing; and discharging said cooling air from said furnace.

20. The method of claim 19 wherein directing step includes the step of directing said cooling air against said, back wall of said burner chamber to cause said cooling air to flow between said exhaust tubes.

21. The method of claim 20 wherein said generally horizontal baffle apparatus includes a plurality of planar baffles mounted to said exterior surface of said burner chamber and extending along said length of said burner chamber away from said header, said directing step including the step of capturing said cooling air between said planar baffles and said exterior surface of said burner chamber to force said cooling air to move in said laminar flow path.

22. In a oil-fired furnace having a generally cylindrical burner chamber in which fuel is burned to create heat and a flow of combustion gases, said burner chamber being formed with a curved exterior surface, and a limit switch mounted on said burner chamber to initiate the flow of cooling air from a blower to pass air through said furnace, the improvement comprising:

said limit switch being mounted on a mounting plate fixed to said exterior surface of said burner chamber in a manner such that said mounting plate will be heat conductive with said burner chamber and be warmed to a substantially identical temperature as said exterior surface of said burner chamber, said mounting plate and said limit switch being engaged along a generally planar contact surface.

23. The furnace of claim 22 wherein said mounting plate is welded to said exterior surface of said burner chamber.

24. In an oil-fired furnace having a burner chamber for burning fuel to create heat and combustion gases, and a blower for directing a flow of cooling air into engagement with said burner chamber to extract heat therefrom, the improvement comprising:

a generally vertical baffle forming an annular opening around a exterior surface of said burner chamber to force said cooling air to pass through said annular opening into engagement with said exterior surface of said burner chamber; and a generally horizontal baffle apparatus mounted on said burner chamber to receive said cooling air passing through said annular opening, said generally horizontal baffle being operable to direct said cooling air into a generally laminar flow path against said exterior surface of said burner chamber.

25. The furnace of claim 24 further comprising:

a header spaced rearwardly of said burner chamber; and a generally circular array of exhaust tubes interconnecting said burner chamber and said header to provide a flow path for said combustion gases from said burner chamber into said header for subsequent discharge from said furnace.

26. The furnace of claim 25 wherein said header is formed with a central opening positioned in the middle of said circular array of exhaust tubes, said blower being operable to move at least a portion of said cooling air through said central opening into said circular array of exhaust tubes.

* * * * *